US009255751B1

(12) United States Patent
Beltz

(10) Patent No.: US 9,255,751 B1
(45) Date of Patent: Feb. 9, 2016

(54) BIPOD FIREARM SUPPORT

(71) Applicant: Kasey Dallas Beltz, Wichita, KS (US)

(72) Inventor: Kasey Dallas Beltz, Wichita, KS (US)

( * ) Notice: Subject to any disclaimer, the term of this patent is extended or adjusted under 35 U.S.C. 154(b) by 0 days.

(21) Appl. No.: 14/594,896

(22) Filed: Jan. 12, 2015

Related U.S. Application Data

(60) Provisional application No. 61/925,930, filed on Jan. 10, 2014.

(51) Int. Cl.
*F41A 23/10* (2006.01)

(52) U.S. Cl.
CPC ..... *F41A 23/10* (2013.01)

(58) Field of Classification Search
CPC ..... F41A 23/08; F41A 23/10; F41A 23/12; F41A 23/14; F16M 11/10; F16M 11/2085
USPC ..... 42/94; 89/37.01, 37.03, 37.04, 37.13, 89/40.01, 40.06; 211/64; 248/163.1
See application file for complete search history.

(56) References Cited

U.S. PATENT DOCUMENTS

| | | | | |
|---|---|---|---|---|
| 148,712 | A | 3/1874 | Ketchum | |
| 1,272,106 | A * | 7/1918 | Rimailho | F41A 23/28 89/40.01 |
| 1,618,966 | A * | 2/1927 | Bull | F41A 23/08 42/94 |
| 1,619,113 | A * | 3/1927 | Gorton | F41A 23/12 89/40.06 |
| 1,728,757 | A * | 9/1929 | Haubroe | F41A 23/12 89/40.06 |
| 2,014,762 | A * | 9/1935 | Fergus | F41A 27/06 362/110 |
| 2,386,802 | A | 10/1945 | Johnson, Jr. | |
| 2,420,267 | A | 5/1947 | Sefried | |
| 2,489,293 | A | 11/1949 | Garand | |
| 2,807,904 | A | 10/1957 | Kreske | |
| 2,844,905 | A | 7/1958 | Musser et al. | |
| 3,012,350 | A | 7/1961 | Lies | |
| 3,327,422 | A | 6/1967 | Harris | |
| 3,445,082 | A | 5/1969 | Frazer et al. | |
| 3,938,273 | A | 2/1976 | Tellie | |
| 3,999,461 | A | 12/1976 | Johnson et al. | |
| 4,055,017 | A | 10/1977 | Thompson | |
| 4,068,961 | A | 1/1978 | Ebner et al. | |
| 4,109,364 | A | 8/1978 | Wisner | |
| 4,265,045 | A | 5/1981 | Garbini | |
| 4,351,224 | A | 9/1982 | Curtis | |
| 4,393,614 | A | 7/1983 | Pickett | |
| 4,470,216 | A | 9/1984 | Harris | |
| 4,564,166 | A | 1/1986 | Craft | |
| 4,607,561 | A | 8/1986 | Frimer | |
| 4,625,620 | A | 12/1986 | Harris | |
| 4,641,451 | A | 2/1987 | Harris | |
| 4,747,489 | A | 5/1988 | Saalfeld | |
| 4,844,390 | A | 7/1989 | Duke | |
| 4,903,425 | A | 2/1990 | Harris | |

(Continued)

*Primary Examiner* — Bret Hayes

(57) ABSTRACT

A bipod includes a mount body, a clutch assembly, a clamp member, a side plate assembly including spaced side plates and legs. The mount body is suitable for mounting to a firearm. The clutch assembly is rotatably mounted to the mount body and is divided into lower and upper portions which define side plate slots suitable for receiving the side plates of the side plate assembly. The clamp member is common to the mount body and the clutch assembly. The clamp member can be tightened to fix the side plate assembly relative to the clutch assembly and the clutch assembly relative to the mount body or can be loosened to allow the side plate assembly to slide through the clutch assembly and the clutch assembly to rotate relative to the mount body. The bipod is supported by the legs which extend downwardly from opposite ends of the side plate assembly.

8 Claims, 8 Drawing Sheets

(56) References Cited

U.S. PATENT DOCUMENTS

| | | | | |
|---|---|---|---|---|
| 4,987,694 | A | 1/1991 | Lombardo | |
| 5,029,407 | A | 7/1991 | Kirkpatrick | |
| 5,074,188 | A | 12/1991 | Harris | |
| 5,081,782 | A | 1/1992 | Wright | |
| 5,102,081 | A | 4/1992 | Barchus | |
| 5,145,134 | A | 9/1992 | Hashimoto | |
| 5,194,678 | A | 3/1993 | Kramer | |
| 5,345,706 | A | 9/1994 | Brown | |
| 5,347,740 | A | 9/1994 | Rather et al. | |
| 5,467,228 | A | 11/1995 | Lin | |
| 5,491,920 | A | 2/1996 | McCullers | |
| 5,593,239 | A | 1/1997 | Sallee | |
| 5,704,188 | A | 1/1998 | Coulis | |
| 5,711,103 | A | 1/1998 | Keng | |
| 5,815,974 | A | 10/1998 | Keng | |
| 5,933,999 | A * | 8/1999 | McClure | B60R 7/14 42/94 |
| 5,937,560 | A | 8/1999 | Beltz | |
| 6,487,807 | B1 | 12/2002 | Kopman | |
| 6,517,133 | B2 | 2/2003 | Seegmiller et al. | |
| 6,560,911 | B2 | 5/2003 | Sharp | |
| 6,763,627 | B1 | 7/2004 | Kaempe | |
| 6,785,997 | B2 | 9/2004 | Oz | |
| 6,843,015 | B2 | 1/2005 | Sharp | |
| 6,875,161 | B1 | 4/2006 | Brice | |
| 7,614,174 | B1 | 11/2009 | Beltz | |
| 7,793,454 | B1 | 9/2010 | Beltz | |
| 7,836,811 | B1 * | 11/2010 | Gardner | F41A 23/28 102/402 |
| 8,231,088 | B2 * | 7/2012 | Lu | F16M 11/34 248/163.1 |
| 8,402,684 | B1 | 3/2013 | Beltz | |
| 8,904,693 | B1 | 12/2014 | Beltz | |
| 2002/0074467 | A1 | 6/2002 | Harris | |
| 2003/0192223 | A1 | 10/2003 | Sharp | |
| 2004/0051010 | A1 * | 3/2004 | Blackburn | F16M 11/32 248/163.1 |
| 2005/0188597 | A1 | 9/2005 | Keng | |
| 2005/0242250 | A1 * | 11/2005 | Keng | F16M 11/10 248/168 |
| 2012/0144717 | A1 * | 6/2012 | Peterson | F41G 11/003 42/94 |
| 2014/0115940 | A1 * | 5/2014 | Bonelli | F41A 23/10 42/94 |

* cited by examiner

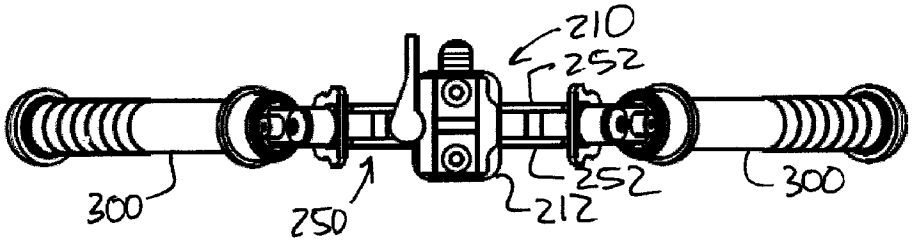
FIG. 9
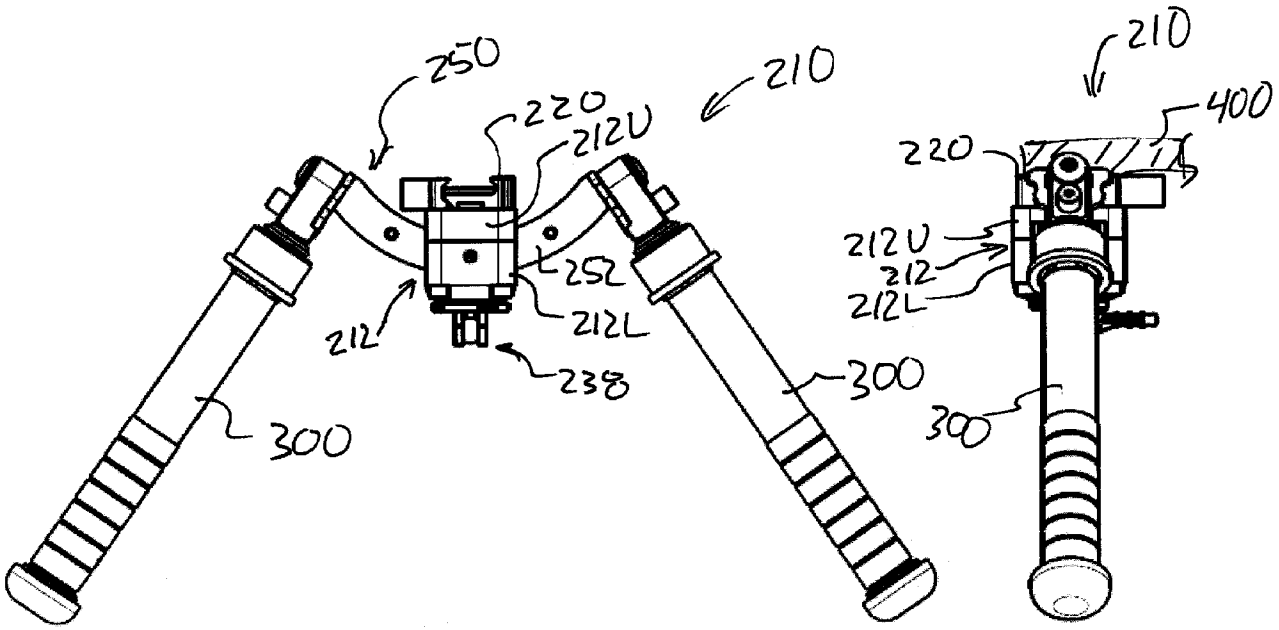
FIG. 8
FIG. 10

BIPOD FIREARM SUPPORT

CROSS REFERENCES TO RELATED APPLICATIONS

This application claims the benefit of Provisional Patent Application Ser. No. 61/925,930 filed on Jan. 10, 2014 which is incorporated herein by reference.

FIELD OF THE INVENTION

This invention relates to a bipod support for supporting the muzzle end of a firearm.

BACKGROUND

Firearm marksmen, particularly military sharp shooters, have a need for supporting the forward end of a firearm in a stable adjustable manner. Often, a bipod support is used for such front-end firearm support. Military sharp shooters have a particular need for a portable, lightweight and retractable bipod which also offers significant degrees of adjustability. In particular, it would be useful to have a bipod support having pivotably mounted legs wherein the legs may be adjusted to various positions including a retracted position in which the legs are generally parallel to the longitudinal axis of the firearm. It would also be useful to be able to position both legs in a forward position or to position the legs in different positions. It would also be useful for the legs of such a bipod to have adjustable telescoping portions for adjusting the length of the legs. Moreover, it would be useful if such a bipod support were adapted to allow pivoting adjustment about a vertical axis and a horizontal axis with respect to the legs of the bipod for aiming adjustment.

SUMMARY

The aforementioned needs are addressed by an improved bipod firearm support. The bipod firearm support is operable for supporting the forestock of a firearm. The bipod includes a mount body, a clutch assembly, a side plate assembly, support legs and a clamp member. The mount body is suitable for attaching to the forward portion of a firearm. The clutch assembly is attached to the mount body and is able to rotate with respect to the mount body around an upright axis. The side plate assembly includes at least one side plate which is slidably and adjustably received by at least one corresponding side plate slot in the clutch assembly. The clutch assembly is divided into a lower portion and an upper portion which together define the at least one side plate slot. The clamp member is common to the lower and upper portions of the clutch assembly and the mount body. The clamp member is able to be adjusted between a loose condition and a tightened condition. When the clamp member is sufficiently tight, the clutch assembly and the at least one side plate are effectively fixed relative to the mount body. When the clamp member is sufficiently loose, the clutch assembly is able to rotate relative to the mount body and the at least one side plate is able to slide through the at least one side plate slot. The support legs extend downwardly from opposite ends of the at least one side plate and are suitable for supporting the bipod and the firearm.

BRIEF DESCRIPTION OF THE DRAWINGS

FIG. 8 is a front view of the second embodiment of the bipod firearm support.

FIG. 9 is a top view of the second embodiment of the bipod firearm support.

FIG. 10 is a side view of the second embodiment of the bipod firearm support.

DETAILED DESCRIPTION

Figure 1:
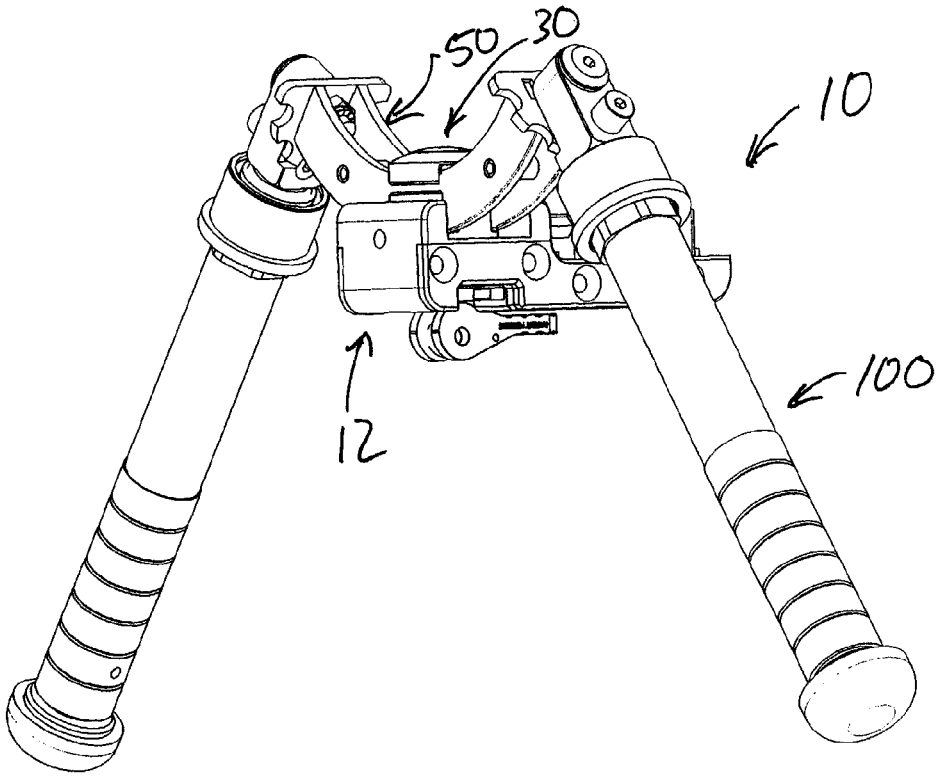
FIG. 1 is a perspective view of one embodiment of the bipod firearm support.

Referring to the drawings, FIGS. 1-4 illustrate one embodiment of a bipod firearm support 10. Bipod firearm support 10 includes a mount body 12, a clutch assembly 30, a side plate assembly 50 and leg assemblies 100. Mount body 12 supports a firearm clamp 20 which, in this example is adapted for securely engaging a rail mounted to the forestock of a firearm which is of a type well known to those skilled in the art. In this example, clutch assembly 30 is secured to mount body 12 at a location that is opposite firearm clamp 20. Side plate assembly 50, in this example, includes two matching, parallel side plates 52. In this example, side plates 52 are shaped and positioned so that their centers of curvature is above clutch assembly. Two spaced pins 54 extend between side plates 32. A pair of position plates 56 are also fixed to the opposite ends of side plates 52 to complete the side plate assembly 50.

Figure 3:
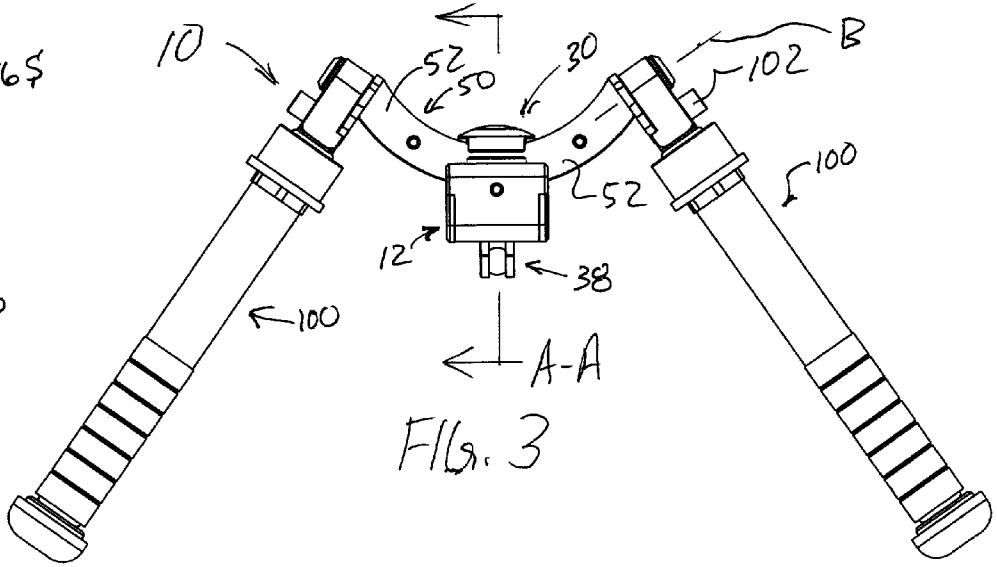
FIG. 3 is a front view of one embodiment of the bipod firearm support.
Figure 4:
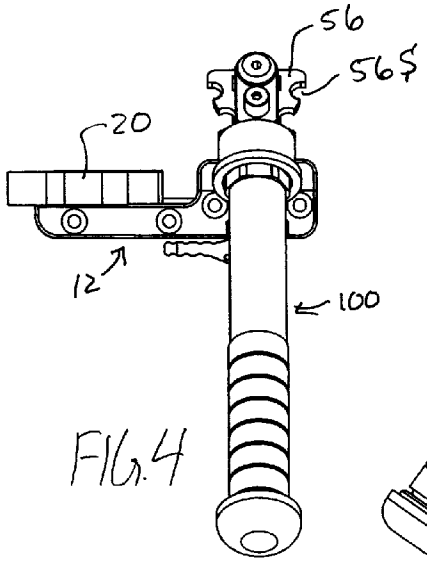
FIG. 4 is a side view of one embodiment of the bipod firearm support.
Figure 6:
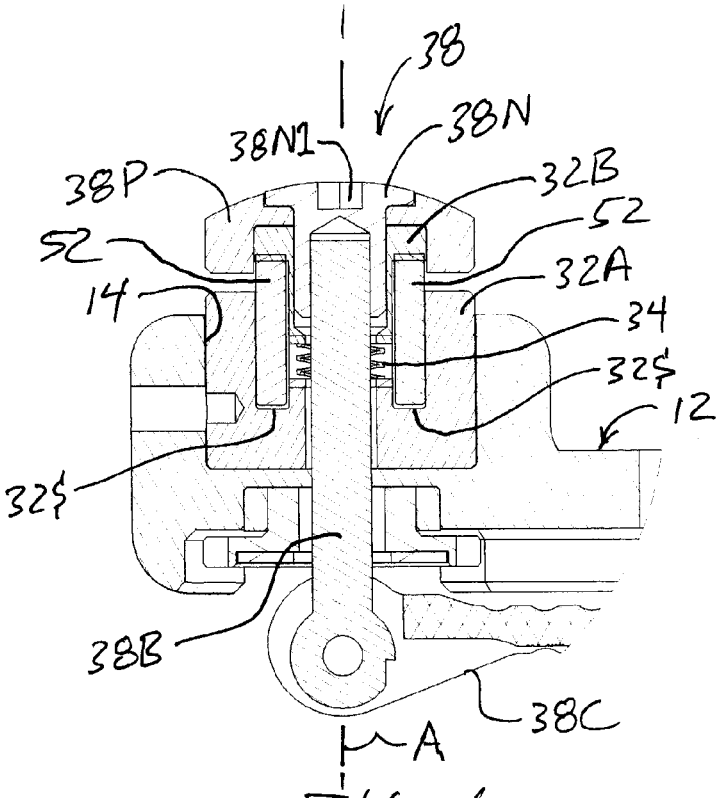
FIG. 6 is a magnified cross section view taken from a portion of FIG. 5.
Figure 5:
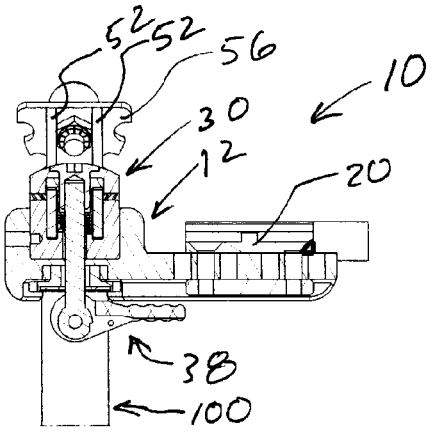
FIG. 5 is a cross section view of one embodiment of the bipod firearm support taken from plane A-A indicated in FIG. 4.
Figure 7:
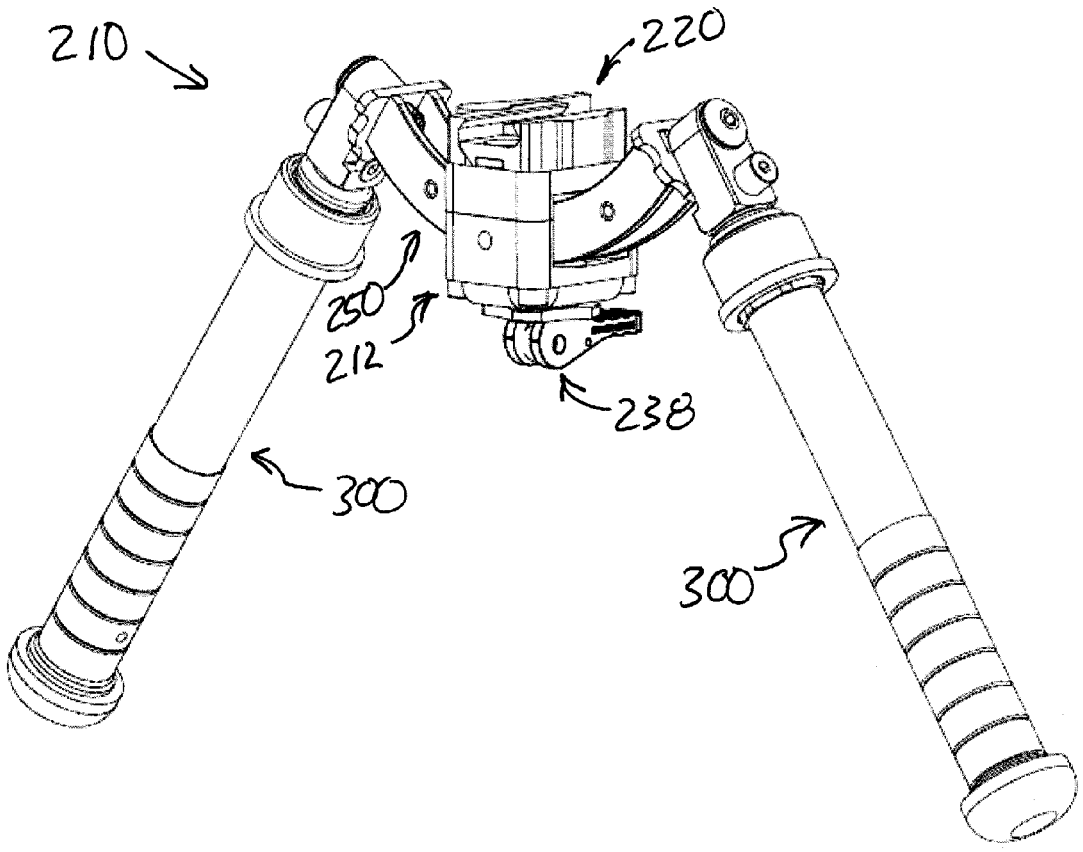
FIG. 7 is a perspective view of a second embodiment of the bipod firearm support.
Figure 8A:
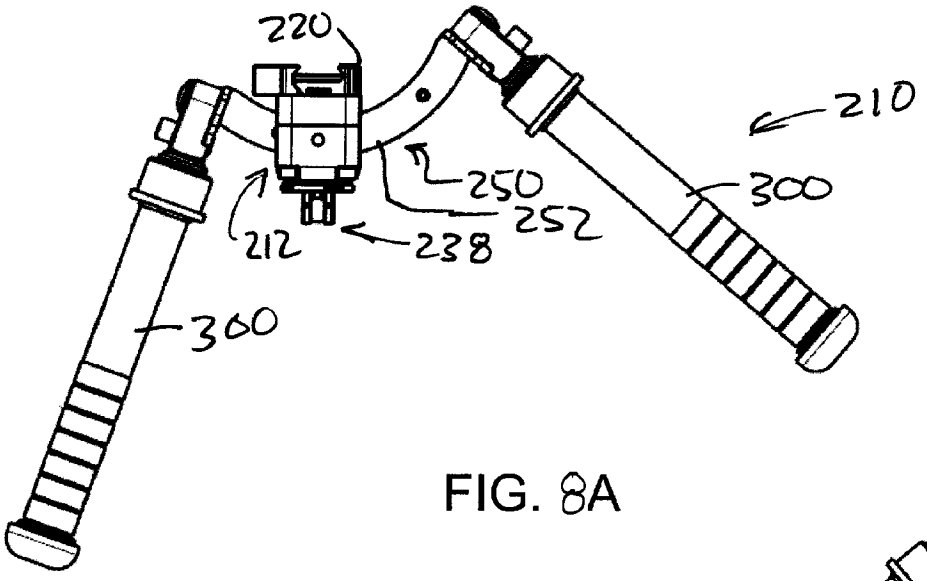
FIG. 8A is a front view of a second embodiment of the bipod firearm support showing the mount body in a first canted right position.
Figure 8B:
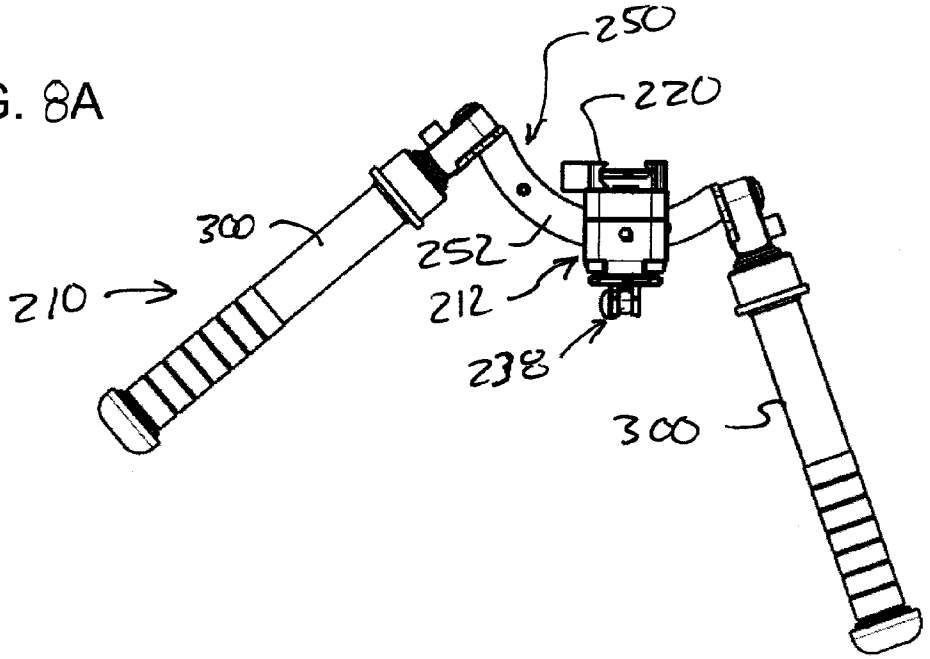
FIG. 8B is a front view of a second embodiment of the bipod firearm support showing the mount body in a second canted left position.
Figure 9B:
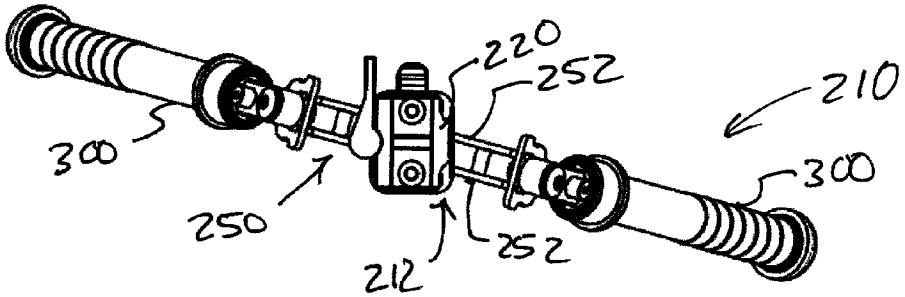
FIG. 9B is a top view of the second embodiment of the bipod firearm support showing the mount body in a second panned left position.
Figure 9A:
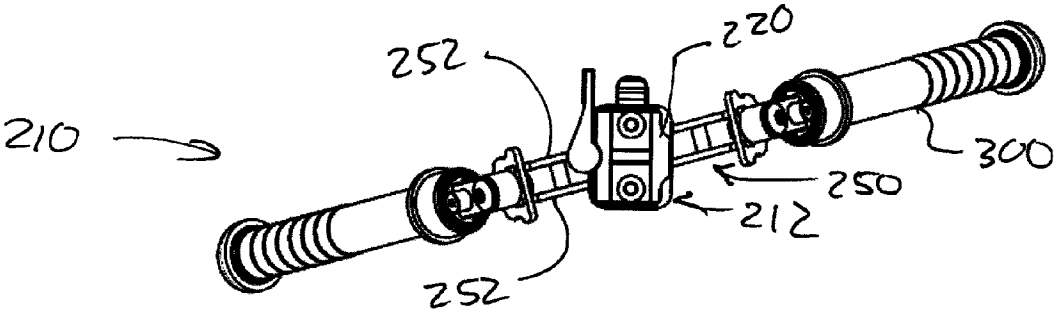
FIG. 9A is a top view of the second embodiment of the bipod firearm support showing the mount body in a first panned right position.

Clutch assembly 30 can be better understood by referring to FIGS. 3, 5 and 6. Clutch assembly 30 includes a lower portion 32A and an upper portion 32B. Taken together, lower portion 32A and upper portion 32B of clutch body 32 present parallel, spaced transverse side plate slots 32S which receive side plates 52. Clutch assembly 30 is also pivotably received by mount body 12 for pivoting about an upright axis between first and second positions as will be described in greater detail below. A clamp member 38 is connected to mount body 12 and both lower and upper portions 32A and 32B of clutch assembly 30. In this example, clamp member 38 is a cam actuated clamp bolt which is common to mount body 12 and both lower and upper portions 32A and 32B of clutch assembly 30. When clamp member 38 is sufficiently tightened, lower and upper portions 32A and 32B are compressed around side plates 52. This causes side plates 52 to be fixed within in clutch assembly 30 so that side plates 52 are unable to slide back and forth through the side plate slots defined by lower and upper portions 32A and 32B of clutch assembly 30. Also, when clamp member 38 is sufficiently tightened, clutch assembly 30 is unable rotate relative to mount body 12.

The details of clutch assembly 30 can be best understood by referring to FIGS. 3, 5 and 6. FIG. 3 is a front view of the bipod which shows how arc shaped side plates 52 of side plate assembly 50 extends on either side of clutch assembly 30. As can be seen in FIG. 6, lower portion 32A and upper portion 32B of clutch body 32 together define and present transverse side plate slots 32S which receive side plates 52 of side plate assembly 50. When clutch assembly 30 is loosened, it is possible to slide side plate assembly 50 through clutch assembly 30. As noted above, side plates 52 are arc shaped and, in this example, their centers of curvature are located generally above clutch assembly 30. This configuration allows the firearm marksman to change the tilt of the firearm around a longitudinal axis which closely parallels the axis defined by the center of the firearm barrel. This tilting motion changes the cant of the weapon as side plates 52 slide through the slots 32S of clutch assembly 30. In this example, by sliding side plate assembly 50 through side plate slots 32S, side plate assembly 50 may be adjustably slid from a full right position, through a neutral position shown in FIG. 3 to a full left position. Further, in this example, the difference between the neutral position and either one of the full left or right canted positions is approximately 15 angular degrees.

Clutch assembly 30 is also configured to allow the rotation of mount body 12 (and by extension the firearm fixed to mount body 12) relative to clutch assembly 30 about an upright axis passing though the center of clutch assembly 30. Thus, a firearm mounted to bipod 10 may be panned from right to left while bipod 10 continues to support the firearm and while side plate assembly 50 and leg assemblies 100 remain generally stationary.

Figure 2:
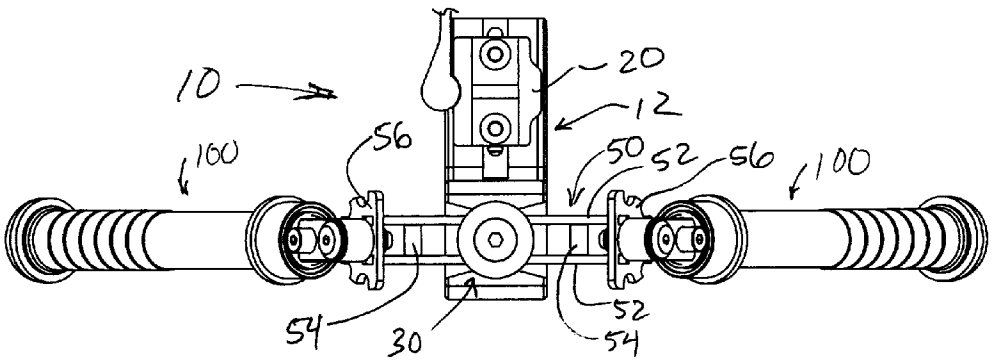
FIG. 2 is a top view of one embodiment of the bipod firearm support.

FIG. 5 is cross section view taken from plane A-A indicated in FIG. 3. FIG. 5 is a magnified partial view of FIG. 6 which focuses on clutch assembly 30. As can be seen in FIG. 6, side plates 52 are received by slots defined in clutch assembly 30. As noted above, clutch assembly 30 includes a lower portion 32A and an upper portion 32B. In this example, both lower portion 32A and upper portion 32B are fashioned from Ultra-High Molecular Weight (UHMW) polyethylene. However, any one of a number of suitable materials which might include various hard plastics may be selected for upper and lower portions 32A and 32B. In this example, at least lower portion 32A of clutch assembly 30 is cylindrical and is received by a corresponding cylindrical cavity 14 in mount body 12 for rotation about upright axis A indicated in FIG. 6. As can be seen in FIG. 2, in this example, the angular extent of this rotation is limited by the range of motion allowed by a pair of diverging channels 12C which are defined on opposite sides of mount body 12 to accommodate the limited motion of side plate assembly 50. In this example, the maximum panning rotation either to the right or the left allowed by this mechanism is approximately 15 angular degrees from the neutral position shown in FIG. 2.

A clamp member 38 is used to selectively tighten and loosen clutch assembly 30. As can be seen in FIG. 6, in this example clamp member 38 is a clamp bolt arrangement which includes a clamp bolt 38B, a cam lever 38C, nut 38N and a nut plate 38P. Clamp bolt 38B extends through mount body 12 and threadably engages nut 38N. Nut 38N, in turn engages nut plate 38P which is in contact with the upper surfaces of upper portion 32B of clutch body 32. As can also be seen in FIG. 6, a compression spring 34 is positioned between the lower end of upper portion 32B and an inside upper surface of lower portion 32A adjacent to bolt 38B. Spring 34 biases upper portion 32B away from lower portion 32A thereby opening slots 32S for free movement of side plates 52 through slots 32S unless slots 32S are clamped against the upper and lower surfaces of side plates 52 by the action of clamp bolt assembly 38 as described herein. As can be seen in FIG. 6, in this example, nut 38N has an Allen wrench recess 38N1 which can be used to adjust the position of nut 38N. When cam lever 38C is rotated into the position shown in FIG. 6, and if nut 38N is properly adjusted, bolt 38B is pulled down and upper portion 32B is forced downwardly causing side plates 32A to be clamped into place and to cause lower portion 32A of clutch assembly 30 to be clamped into place relative to mount body 12. The firearm marksman can adjust the amount of tension that can be applied by turning cam lever 38C to the position shown in FIG. 6 by adjusting nut 38N by engaging an Allen wrench with Allen wrench recess 38N1 and tightening or loosening nut 38N. This cam mechanism is similar to the quick release mechanism employed for securing the skewers of bicycle wheels to bicycle frames and is employed in many other mechanical devices for which rapid and easy tightening and loosening is called for. The skilled reader will be able to envision a number of other mechanisms which might be employed to provide a way to quickly tighten or loosen clutch assembly 30.

As noted above, leg assemblies 100 are adjustably mounted to position plates 56. Recall that position plates 56 are fixed to the opposite ends of side plates 52. In this example, position plates 56 are identical and are angled so that a leg assembly 100 will extend down and away from mount body 12 at an angle of approximately 30 degrees when the leg assembly is in the downwardly extended position. Each position plate 56 presents a generally flat mounting surface 58. The outer edge of each position plate 56 presents a pattern of recesses 56S. In this example, the pattern includes five recesses for a (1) a forward folded position, (2) a forward down position, (3) a down position, (4) a backward down position and (5) a backward folded position. Each leg assembly 100 is pivotably mounted to position plate 56 for rotation about axis B indicated in FIG. 3. A spring biased pin 102 is used to selectively engage one of recesses 56S to position leg assembly 100. This mechanism is similar to the one shown in FIG. 3A of U.S. Pat. No. 8,402,684 issued to the applicant and which is incorporated herein by reference in its entirety. This arrangement makes it possible to position the legs as noted above and to position the legs independently in various positions as is sometimes very useful when a firearm marksmen is using a weapon in an unusual position or using the bipod on irregular or uneven surfaces.

As also noted above, leg assemblies 100 may be adjusted for length in a telescoping fashion. An example telescoping mechanism for leg assemblies 100 is shown and described in detail in U.S. Pat. No. 8,402,684 which is incorporated herein by reference.

Referring to the drawings, FIGS. 7-12 illustrates a second embodiment of a bipod firearm support 210. As can be seen in FIGS. 7-12, bipod firearm support 210 includes a mount body 212, a clutch assembly 230, a side plate assembly 250 and leg assemblies 300. In this example leg assemblies 300 are identical to leg assemblies 100 described above and will not be discussed for this second embodiment. Mount body 212 supports a firearm clamp 220 which, in this example, is adapted for securely engaging a rail mounted to the forestock of a firearm which is of a type well known to those skilled in the art. In this example, clutch assembly 230 is secured to mount body 212 at a location that is below the interface for connecting to firearm clamp 220. As was the case with side plate assembly 50, side plate assembly 250, in this example, includes two matching, parallel side plates 252. Side plate assembly 250 may be essentially identical to side plate assembly 50 described above.

The primary difference between bipod 10 and bipod 210 is that a portion of mount body 12 of bipod 10 which carried fire arm clamp 20 has, in effect, been relocated to a position directly above clutch assembly 230. Accordingly, the mount body 212 is split into a lower portion 212L and an upper portion 212U.

Figure 11:
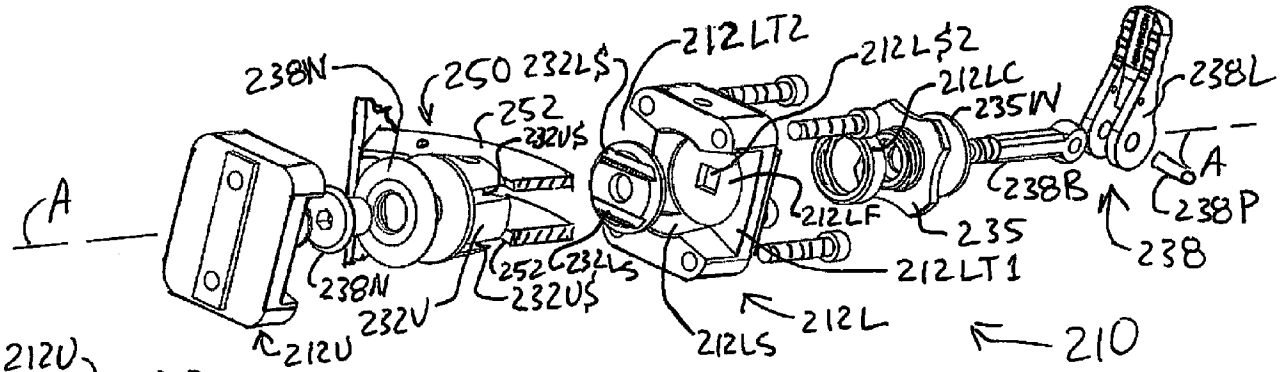
FIG. 11 is a first exploded isometric view of the second embodiment of the bipod firearm support showing the mount body, the clutch assembly and portions of the side plate assembly.
Figure 12:
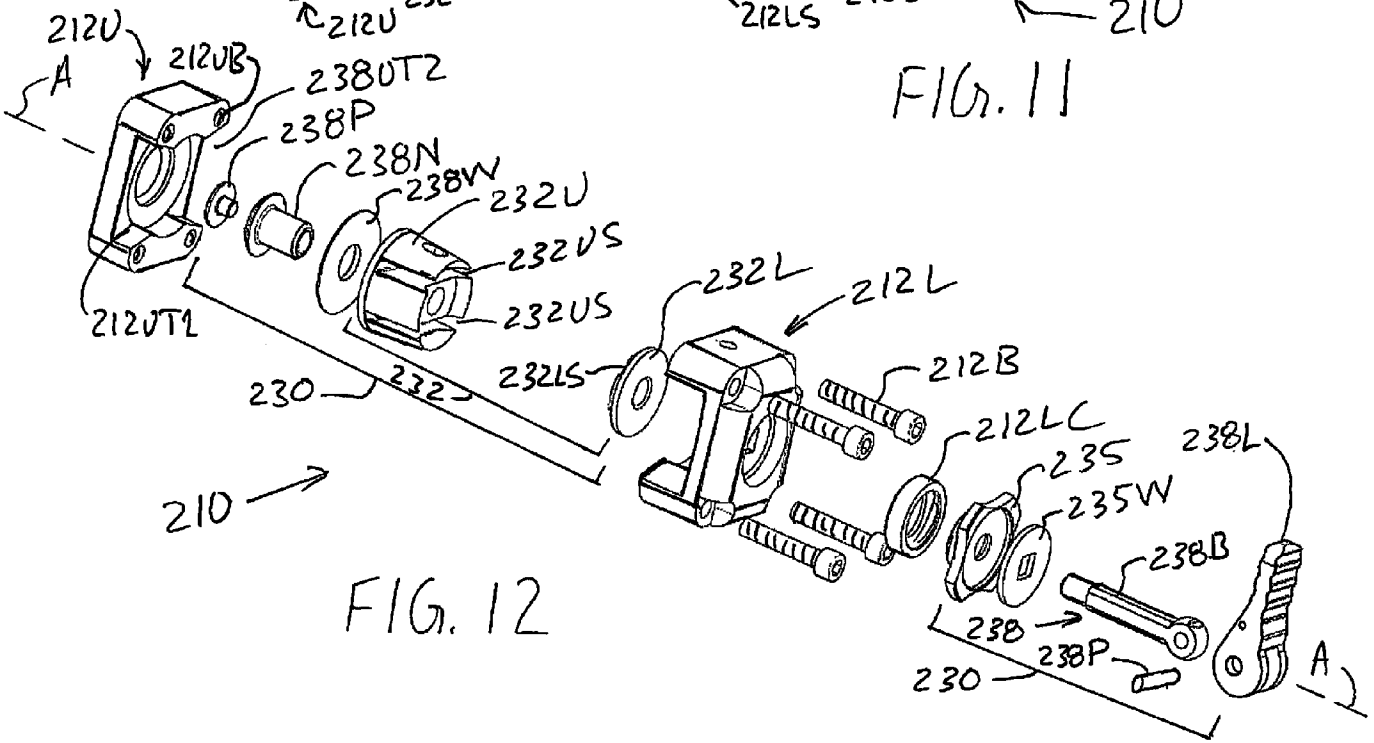
FIG. 12 is a first exploded isometric view of the second embodiment of the bipod firearm support showing the mount body, the clutch assembly and portions of the side plate assembly

Clutch assembly 230 can be better understood by referring to FIGS. 11-12. Clutch assembly 230 includes a cradle 232 which includes a lower cradle portion 232L and an upper cradle portion 232U. Taken together, lower cradle portion 232L and upper cradle portion 232U of clutch assembly 230 present parallel, spaced transverse side plate slots 232US and 232LS which receive side plates 252. When clutch assembly 230 is relatively loose, it is possible to slide side plate assembly 250 between a right cant position shown in FIG. 8A and a left cant position shown in FIG. 8B. As noted above, clutch assembly 230 is also rotatably received by mount body 212 for rotation about an upright axis. However, that rotation is limited between a first pan right position shown in FIG. 9A and a second pan left position shown in FIG. 9B. A clamp member 238 fastens together mount body lower portion 212L and both lower and upper portions 232L and 232U of cradle 232. In this example, clamp member 238 is a cam actuated clamp bolt which is common to the lower portion 212L of mount body 212 and both lower and upper cradle portions 232A and 232B of cradle 232. When clamp member 238 is sufficiently tightened, lower and upper portions 232L and 232U are compressed around side plates 252 and lower portion 232L of cradle 232 is pressed into lower portion 212L of mount body 212. This causes side plates 252 to be generally fixed within clutch assembly 230 so that side plates 252 are at least difficult to slide back and forth through the side plate slots defined by lower and upper portions 232A and 232B of clutch assembly 230. Also, when clamp member 238 is tightened, the force required to pivot clutch assembly 230 is relative to mount body 212 is also increased so that it at least becomes difficult to pan mount body 212 relative to side plate assembly 250 and bipod legs 300.

Mount body 212 and clutch assembly 230 may be considered in greater detail by referring to FIGS. 11 and 12 which provide exploded perspective views of mount body 212 and clutch assembly 230. The skilled reader should bear in mind that the details shown in FIGS. 11 and 12 and described herein illustrate just one embodiment of the bipod of the present invention. The various details shown and described here provide merely one example of how the bipod may be arranged. As can be seen in FIGS. 11 and 12, mount body 212 is divided into an upper portion 212U and a lower portion 212L. In this example, mount body 212 is fastened together by four bolts 212B which are received by corresponding holes 212LB in lower portion 212L and which thread into corresponding threaded holes 212UB in upper portion 212U. In this example, an internally threaded collar 212LC is force fit (and therefore fixed) into a collar recess 212LCR defined in the bottom surface of lower portion 212L. In this example, separate threaded collar 212LC is used because it can be fashioned from a material, such as stainless steel, which is suitable for accepting fine threads which, in turn, receive the threads of an tension adjustment wheel 235. Most likely, tension adjustment wheel 235 will be subjected to frequent use.

Various features of mount body 212 may be understood by referring to FIGS. 11 and 12. As can be seen in FIG. 11, the upper surface of upper portion 212U presents a raised rail feature 212UR. Two spaced threaded holes 212URH are also defined at opposite end of rail feature 212UR. In this example, threaded holes 212URH may be used to receive machine screws suitable for securing to upper portion 212U any one of a number of fittings (not shown) suitable for attaching to various types of firearm features. It is also possible to provide numerous interchangeable upper portions 212U which present features suitable for mounting with various fittings for mounting to firearms or various features suitable for mounting directly to firearms.

As can be seen in FIGS. 11 and 12, the inside surfaces of lower portion 212L and upper portion 212U of mount body 212 are shaped to receive cradle 232 of clutch assembly 230 as well as side plates 252 of side plate assembly 250. As will be described in greater detail below, in this example, cradle 232 is axially symmetrical about an axis A and is arranged to rotate within mount body 212 about axis A. In this example, the inside surfaces of mount body 212 define a frusto-conical recess for receiving cradle 232 and also present side channels for providing clearance for side plates 252 of side plate assembly 250. In particular, as can be best seen in FIG. 11, the frusto-conical recess is defined by a frusto-conical side wall 212LS which extends upwardly on the front and back interior sides of lower portion 212L and also extends up from a narrow ring-like portion which extends down to define a circular edge with the interior floor 212LF of lower portion 212L.

As can be best seen in FIG. 11, frusto-conical surface 212LS is interrupted by two opposite symmetrical diverging bow-tie shaped side channels 212LT1 and 212LT1 which extend outwardly and laterally from the interior of lower portion 212L. Side channels 212LT1 and 212LT2 are arranged to provide clearance for side plates 252 as mount body 212 is pivoted about axis A. Side plate assembly 250 is partially shown in FIG. 11 with most of one side of side plate assembly 250 cut away for clarity. By referring to FIG. 11, it is possible to visualize how side plates 252 of side plate side plate assembly 250 do not interfere with lower portion 212L as mount body 212 rotates about axis A relative to side plate assembly 250 within a limited angle of rotation. Recall that legs 300 which are shown in FIG. 10 extend down from the right and left ends of side plate assembly 250. These legs and side plate assembly 250 remain generally stationary as the firearm is panned from left to right thereby causing mount body 212 to pivot around axis A. In this example, the limited angle of rotation for panning may be approximately 15 degrees to the left and to the right (or 30 degrees total travel). Accordingly side channels 212LT1 and 212LT2 diverge at an angle of approximately 15 degrees.

The interior floor 212LF of mount body lower portion 212L presents a square opening 212LS2 which is centered on axis A. Square opening 212LS2 is used in this example to receive the flat sided clamp member 238. This arrangement secures clamp member 238 from pivoting about axis A. Clamp member 238 is a component of clutch assembly 230 which will be described in greater detail below Mount body upper portion 212U may be best seen in FIG. 12. As can be seen in FIG. 12, mount body upper portion 212U also presents an upper recess 212UR which is also interrupted by bow-tie shaped side channels 212UT1 and 212UT2 which generally match side channels 212LT1 and 212LT2 of lower portion 212L and which are adapted to also provide clearance for the panning movement of side plate assembly 250 described above.

Clutch assembly 230 is also best understood by referring to FIGS. 10-12. As can be seen in FIG. 10, clutch assembly 230 extends between a clamp member bolt 238B and a clamp nut 238N. As can be seen in FIGS. 10 and 11, clutch assembly 230 includes a cradle 232 which is further divided into a lower cradle portion 232L and an upper cradle portion 232U. When assembled, cradle 232 presents a frusto-conical outside surface which is shaped to match the frusto-conical surface 212LS of mount body lower portion 212L described above. Moreover, lower cradle portion 232L presents a bottom surface which matches interior floor 212LF of mount body lower portion 212L. As can be seen in FIGS. 11 and 12, a hole centered on axis A extends through cradle 232 and is sized to allow relative rotation of cradle 232 about axis A relative to flat sided clamp member bolt 238B. In this example, lower cradle portion 232L and upper cradle portion 232U present transverse slots 232LS and 232US respectively which are arranged to slidably receive side plates 252 of side plate assembly 250. The depths of these corresponding slots are arranged such that, preferably, there is still some separation between the upper and lower portions of cradle 232 when the upper and lower portions of cradle 232 are clamped together and therefore are clamping around side plates 252. This is necessary so that it is possible to clamp cradle 232 around side plates 252 to prevent side plates 252 from sliding through the side plate slots as will be described in further detail below. In this example, both lower portion 232L and upper portion 232U are fashioned from Ultra-High Molecular Weight (UHMW) polyethylene. However, both lower and upper portions 232L and 232U be fashioned from any one of a number of materials suitable for such an application.

The assembly of clutch assembly 230 may be best understood by referring to FIG. 12. Recall that threaded collar 212LC is force fitted into mount body lower portion 212L. Further a tension adjustment wheel 235 is also threaded into the internal threads of collar 212LC. In this example, pin 238P is received by the lower end transverse hole in clamp member bolt 238B and is also force fitted into offset holes in a cam lever 238L so that cam lever 238L is pivotably mounted to the lower end of clamp member bolt 238B. In this example, a washer 255W is received by a corresponding recess in the lower surface of tension adjustment wheel 235. Washer 255W also has a square hole which fixes washer 255W with respect to flat sided clamp member bolt 238B. Clamp member bolt 238B extends through square opening 212LS2 of mount body lower portion 212L which causes the flat sided clamp member bolt 238B to be rotationally fixed with respect to mount body lower portion 212L. To further assemble bipod 210, side plates 252 of side plate assembly 250 are placed in the corresponding side plate slots 232CLS of lower cradle portion 232CL and side plate slots 232CUS of upper cradle portion 232CU. The upper and lower portions of cradle 230 can be pulled together and pulled against mount body lower portion 212L if clamp member nut 238N is threaded onto the threaded upper portion of clamp member bolt 238B so as to apply pressure to washer 238W which in turn pushes down on the top surface of upper cradle portion 232U. In this example, an optional plug 238P is provided for plugging the Allen wrench hole in the top of nut 238N for preventing foreign objects and particles from entering the interior of cradle 232.

Although it is possible for the top surfaces of the top components of clutch assembly 230 to rotate with in the axially symmetrical recesses defined in the lower surfaces of mount body upper portion 212U, it is most preferable for nut 238N to be sufficiently tightened so that rotation contact between cradle 232 occurs mainly with mount body lower portion 212L. The primary purpose of mount body upper portion 212U is to provide a platform for mounting hardware suitable for mounting to a firearm.

Once clamp assembly 230 has been assembled as described above, it is possible to rotate clamp bolt lever 238L between a loose position and a tight position. When in the loose position, nut 238N is not pulled toward lever 238L with enough force to prevent clamp assembly from rotating with respect to mount body 212 about axis A or to prevent side plates 252 from sliding through the corresponding side plate slots in the lower and upper portions of cradle 232C. Clamp bolt lever 238L presents a cam surface 238LC which is offset from pin 238P. As lever 238L is rotated clamp bolt 238P is pulled downwardly. This causes cradle 232C to be compressed and pulled down upon lower mount body portion 212L thereby increasing the force needed to rotate mount body 212 with respect to side plate assembly 250 about axis A (thereby increasing the force needed to pan the firearm) or to slide mount body 212 relative to side plate assembly 250 (thereby increasing the force needed to cant the firearm). By the same token, by loosening lever 238L, the pressure on side plate assembly 250 is reduced which reduces the force needed to pan and cant. Tension adjustment wheel 235 can be threaded into collar 212LC to decrease the tension that can be applied by clamp bolt 238. Conversely, tension adjustment wheel 235 can be treaded out of collar 212LC to increase the tension that can be applied by clamp bolt 238. Accordingly, the dimensions and thickness of the components described above must be managed carefully so that it is possible to adjust the tension of clamp member 238 as described above.

The skilled reader will appreciate that the above-described details of bipod 210 merely describe one configuration for a mount body and clutch assembly. In this example, the clutch assembly 230 includes two-piece cradle which is rotatably nested in a mount body 212. The two piece cradle 232 also presents side plate slots suitable for slidably receiving the curved side plates 252 of a side plate assembly 250 which are arranged for presenting bipod legs 300. The two-piece cradle 232 is preferably axially symmetrical about a rotation axis and is received by correspondingly shaped recesses in mount body lower portion 212L. An adjustable clamp member 238 common to mount body lower portion 212L and the cradle 232 is able to be adjusted between a tight position and a loose position. When in the tight position, the two-piece cradle 232 clamps the side plates 252 within the cradle 232 and also clamps the cradle 232 to the mount body 212. This action at least increases the force required to either cant or pan mount body 212 relative to leg assemblies 300. When in the loose position, the two piece cradle clamps the side plates 250 to the cradle 232 with less force and also clamps the cradle 232 to the mount body 212 with less force in order to decrease the force required to either cant or pan mount body 212 relative to leg assemblies 300.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A bipod for supporting the forward portion of a firearm comprising:

(a) a mount body suitable for securing to the forward portion of a firearm, (b) at least one side plate having support legs extending from the opposite ends thereof, (c) a clutch assembly having a first portion and a second portion, the first and second portions defining at least one side plate slot suitable for receiving the at least one side plate, (d) a clamp member mechanically associated with the clutch assembly and the mount body, the clamp member adjustable between a loose condition and a tight condition, the clamp member, the mount body, the clutch assembly and the at least one side plate arranged such that when the clamp member is in the loose condition, the clutch assembly is able to rotate relative to the mount body and the at least one side plate is able to slide within the at least one side plate slot, and, the clamp member, the mount body, the clutch assembly and the at least one side plate also arranged such that when the clamp member is in the tight condition, a substantially greater force is required to cause the clutch assembly to rotate relative to the mount body and a substantially greater force is required to cause the at least one side plate to slide within the side plate slot.

2. The bipod firearm support of claim 1, wherein;

the at least one side plate has a position plate at each end of the at least one side plate, and a support leg is adjustably mounted to each position plate such that the angle of the support leg relative to the position plate and the at least one side plate is able to be adjusted.

3. The bipod firearm support of claim 1, wherein;

the at least one side plate is a side plate assembly including two spaced side plates which are curved and which are connected by cross members and the at least one side plate slot of the clutch assembly includes two spaced side plate slots suitable for receiving the side plates of the side plate assembly.

4. The bipod firearm support of claim 3, wherein;

position plates are fixed to the opposite ends of the side plate assembly and the support legs are each adjustably mounted to one of the position plates, the support legs being adjustable in at least a first forward angled position, a second downwardly angled position and a third backward angled position.

5. The bipod firearm support of claim 3, wherein;

the clamp member includes a bolt and a cam lever suitable for movement between a tight condition and a loose condition, the bolt being connected to the mount body and the clutch assembly, the bolt being threadably adjustable in relation to the mount body and the clutch assembly so that the tight condition and the loose condition caused by movement of the cam lever are able to be adjusted.

6. The bipod firearm support of claim 1, wherein;

the clamp member includes a bolt and a cam lever suitable for movement between a tight condition and a loose condition, the bolt being connected to the mount body and the clutch assembly, the bolt being threadably adjustable in relation to the mount body and the clutch assembly so that the tight condition and the loose condition caused by movement of the cam lever are able to be adjusted.

7. A bipod firearm support for supporting the forward portion of a firearm, comprising:

a mount body, a clutch assembly, leg assemblies and a side plate assembly, the mount body operable for securing to a firearm and the clutch assembly rotatably attached to the mount body, the side plate assembly including two spaced curved side plates which are slidably and adjustably received by a corresponding side plate slots in the clutch assembly, the clutch assembly being divided into lower and upper portions which each define at least portions of the side plate slots, a clamp member common to the mount body and both portions of the clutch assembly operable for tightening and loosening to respectively fix the side plate assembly relative to the clutch assembly and to fix the clutch assembly relative to the mount body or free the side plate assembly for relatively sliding motion between the side plate assembly and the clutch assembly and free the clutch assembly for rotation relative to the mount body around an upright axis, the leg assemblies adjustably mounted at opposite ends of the side plate assembly such that each leg assembly is independently positionable in one of a plurality of positions including at least a forward folded position, at least one forward down, a backward down position and a down position.

8. The bipod firearm support of claim 7, wherein;

the clamp member includes a bolt and a cam lever suitable for movement between a tight condition and a loose condition, the bolt being connected to the mount body and the clutch assembly, the bolt being threadably adjustable in relation to the mount body and the clutch assembly so that the tight condition and the loose condition caused by movement of the cam lever are able to be adjusted.

* * * * *